United States Patent [19]

Sherrick et al.

[11] 4,326,670

[45] Apr. 27, 1982

[54] ADJUSTABLE SPRING CLIP

[75] Inventors: James W. Sherrick, Edinboro; Chris E. Casbohm, Conneautville, both of Pa.

[73] Assignee: Lord Corporation, Erie, Pa.

[21] Appl. No.: 162,238

[22] Filed: Jun. 23, 1980

[51] Int. Cl.[3] ..... E01B 9/46; E01B 9/30

[52] U.S. Cl. ..... 238/341; 238/282; 238/283; 238/349

[58] Field of Search ..... 238/349, 310, 287, 338, 238/264, 341, 282

[56] References Cited

U.S. PATENT DOCUMENTS

| | | | |
|---|---|---|---|
| 3,576,293 | 4/1971 | Landis | 238/287 |
| 3,784,097 | 1/1974 | Landis | 238/310 |
| 3,858,804 | 1/1975 | Hixson | 238/264 |
| 3,910,493 | 10/1975 | Wood | 238/349 |
| 4,047,663 | 9/1977 | Reynolds et al. | 238/304 |
| 4,062,490 | 12/1977 | Hixson | 238/338 |

*Primary Examiner*—Richard A. Bertsch

*Attorney, Agent, or Firm*—Thomas L. Kautz

[57] ABSTRACT

A laterally adjustable rail clip fastening means is provided by the present invention for securing a resilient rail clip such as a Pandrol clip to a direct fixation rail mounting assembly, and, in turn, into engagement with a rail. The rail clip fastening means includes a pair of sections formed of rigid material having a curved section at one end to receive and securely hold a resilient rail clip in engagement with a rail. The sections of rigid material are laterally moveable along the top plate of the rail mounting assembly and include cam locking means to independently lock such sections into position against the rail for preventing lateral movement thereof in cooperation with the resilient rail clips.

9 Claims, 7 Drawing Figures

ADJUSTABLE SPRING CLIP

FIELD OF THE INVENTION

This invention relates to the area of rail securing means, and, more particularly, to a laterally adjustable attachment bracket operable to secure a resilient clip such as a Pandrol clip in position against the rail.

BACKGROUND OF THE INVENTION

The increasing depletion of world wide energy reserves has prompted a renewed interest and emphasis on developing efficient, high speed railway systems for rapid transit and freight shipment. One phase of research and development in this area has been directed toward devising a rail mounting system which would minimize routine maintenance while providing improved vibration isolation, noise reduction and electrical insulation. In many of the more modern rail systems in the United States, particularly for rapid transit, the rails are mounted directly to concrete supporting structures. The disadvantages of wooden ties or wooden ties embedded in concrete are well known. Replacement of wooden ties embedded in concrete is difficult and time consuming, and in subway systems for example, the additional vertical height required to accommodate the thickness of wooden ties results in added expense for tunnel construction.

While concrete ties generally involve less maintenance and last longer than wooden ties, so-called direct fixation systems for mounting the rails to concrete supporting structures must provide means to absorb the impact between the rail and concrete, to avoid damage to the concrete and provide energy absorption to dampen vibrations and attenuate noise. One of the most common direct fixation rail mounting systems presently in use includes a base assembly consisting of a layar of resilient energy absorbing elastomer disposed between and attaching to a base plate mounted to the concrete and a top plate which supports the rail. Such base assemblies have proved to be reasonably effective in minimizing deterioration of the concrete supporting structure, and reducing vibration and noise transmission to the railway cars and surrounding areas.

However, it has been found that even where the best installation procedures are used, some degree of lateral adjustment must be included in such base assembly designs to assure that the proper gauge is maintained between rails. This is particularly important in areas where the concrete supporting structures are susceptible to sinking, earthquakes or other causes of shifting. U.S. Pat. Nos. 4,062,490 and 3,868,804 to Hixson, for example, disclose base assembly structures in which the position of the rail may be laterally adjusted at the point of anchorage of the base assembly to the concrete. Threaded bolts are embedded in the concrete on opposite sides of the rail, and extend upwardly through corresponding elongated slots formed in the base plate of the base assembly. Fixed brackets or clips attaching to the top plate contact the rail and hold it securely to the base assembly. The entire base assembly including the rail is thus laterally moveable along the elongated slots and secured in the desired position with nuts tightened on to the threaded anchorage bolts.

An alternative approach is found in U.S. Pat. Nos. 3,576,293 and 3,784,097 to Landis in which the base assembly is held in a fixed position relative to the concrete supporting structure, and the brackets or clips which secure the rail are laterally adjustable along the top plate of the base assembly. As in the Hixson disclosures, threaded bolts and nuts are utilized by the Landis systems at the point of anchorage to the concrete and at the point of attachment of the rail to the top plate of the base assembly.

A problem associated with the systems of both Hixson and Landis is that over a period of time the repeated pounding of the rails against the concrete may cause loosening of the threaded bolt-nut attachments both at the anchorage points and at the rail. Due to the lateral adjustment capability in each of the prior art designs mentioned above, loosening of such attachments could result in lateral movement of the rails even in continuously welded track. This can be particularly dangerous in curves where lateral forces tending to urge the rails apart are most prevalent. Thus, continuous maintenance programs are required with such prior art systems to assure that all bolted connections remain tight. In addition, each of the patents cited above include at least one threaded bolt which extends upwardly from the concrete supporting structure and/or at the point of attachment of a bracket or clip to the rail such that the threads are exposed to the weather. As time passes, oxidation and other deterioration of the threads could present maintenance problems in loosening such attachments for lateral adjustment of the rail, or in simply tightening the nuts to the bolts as they become loosened.

In an effort to avoid the potentially substantial costs required for proper maintenance of the systems described above, resilient, one-piece metal clips including so-called Pandrol clips have been utilized as a durable, relatively maintenance-free alternative. See U.S. Pat. No. 3,910,493. The Pandrol rail clip for example, is a resilient metal bar which is bent or formed in a curved shape such that one section contacts the flange of a rail and a second section is secured to the top plate of the base assembly by some form of attachment means. Once in place, the Pandrol clip needs no adjustment, tightening or other form of maintenance unless a failure should occur requiring replacement.

At least one prior art U.S. Pat. No. 4,047,663 to Reynolds et al, has recognized the advantage of using Pandrol clips in combination with the general configuration of standard base assemblies now commonly is use as discussed above. The Reynolds et at direct rail fixation system utilizes eccentrics at the point of anchorage between the base assembly and concrete supporting structure to provide lateral adjustement of the rail. The anchor bolt extending through the eccentric is inserted into a correspondingly threaded sleeve embedded in the concrete. The top plate of the base assembly is formed with generally circular notches or grooves to receive the Pandrol clip and lock it firmly into position against the rail. A disadvantage of this configuration, however, is the same as that described above in connection with the Hixson systems. If the eccentric anchorage connection should loosen after a period of time, the entire base assembly would be susceptible to shifting in response to lateral forces.

SUMMARY OF THE INVENTION

The present invention overcomes the difficulties in the prior art systems, particularly in the Hixson and Landis configurations, by providing an attachment bracket which is formed to firmly hold a Pandrol clip or similar clip in position to secure a rail and is laterally adjustable along the top plate of the base assembly within given tolerances. Anchorage of the base assembly herein is preferably accomplished by inserting a threaded bolt through a bore in the base assembly and then into a correspondingly threaded sleeve embedded in the concrete supporting structure. Unlike the prior art systems of Hixson and Landis, no threads are exposed to the elements where they could become rusted and make tightening or loosening difficult.

In addition, maintenance requirements of the subject invention are considerably less than with existing systems. The bolt-nut attachment at the rail, found in the Hixson and Landis systems, is completely eliminated. Moreover, the attachment at the point of anchorage of the base assembly to the concrete is not as critical as in the Reynolds et al disclosure. Should the anchorage bolt loosen slightly in the inventive system herein, the base assembly would still be held in place laterally as discussed in detail below. Of course increased vibration of the base assembly would occur, but there would be limited lateral movement, if any. In contrast, the Reynolds et al configuration could permit lateral movement of the entire base assembly and rail, in addition to increased vibration, should the eccentric loosen enough to rotate. Although loosening of the base plate from the concrete supporting structure results in increased vibration and noise, the primary danger of spreading of the gauge between rails is avoided by the subject invention.

Therefore it is an object of this invention to provide a laterally adjustable bracket for securing a Pandrol clip or similar clip to a rail in a direct fixation rail mounting system.

It is another object of the present invention to provide a laterally adjustable bracket for securing a Pandrol or similar rail clip, to be used in combination with a direct fixation rail mounting system having non-adjustable fixed anchorage means to the underlying support structure.

It is a further object of the subject invention to provide a laterally adjustable bracket for securing a Pandrol or similar rail clip to a rail, which is capable of remaining in position adjacent the rail to resist lateral movement thereof independently of the rail clip.

DESCRIPTION OF THE DRAWINGS

Objects in addition to the foregoing will be apparent upon consideration of the following description taken in conjunction with the accompanying drawings, wherein.

DETAILED DESCRIPTION OF THE INVENTION

Figure 1:
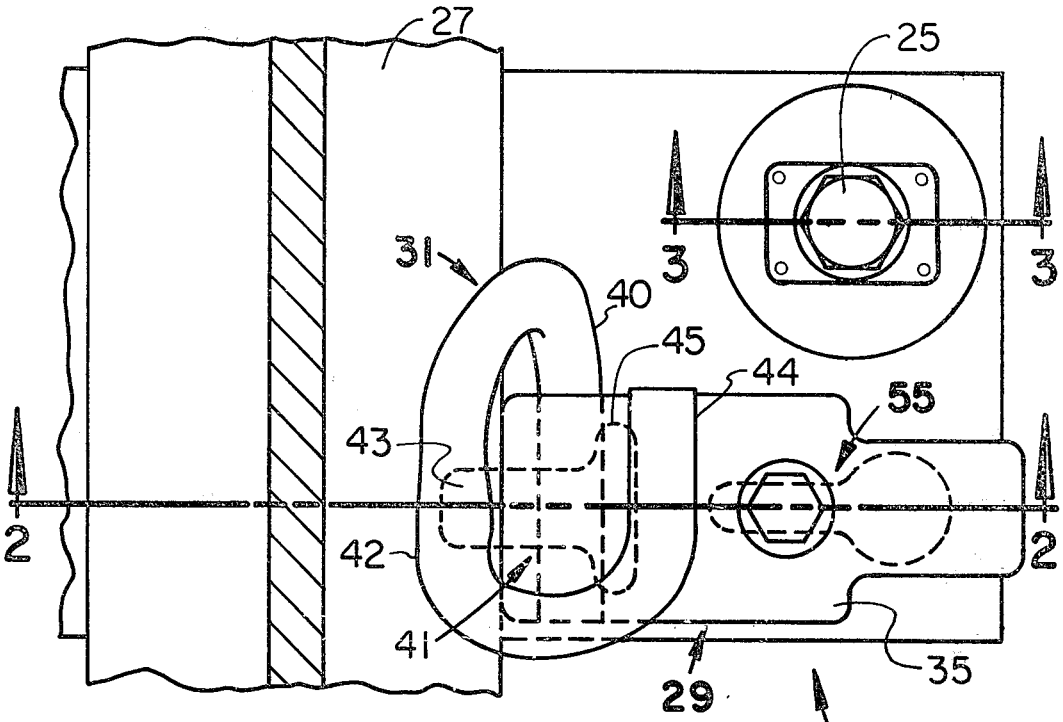
FIG. 1 is a partial top view of a direct fixation base assembly including the bracket means of the present invention.
Figure 2:
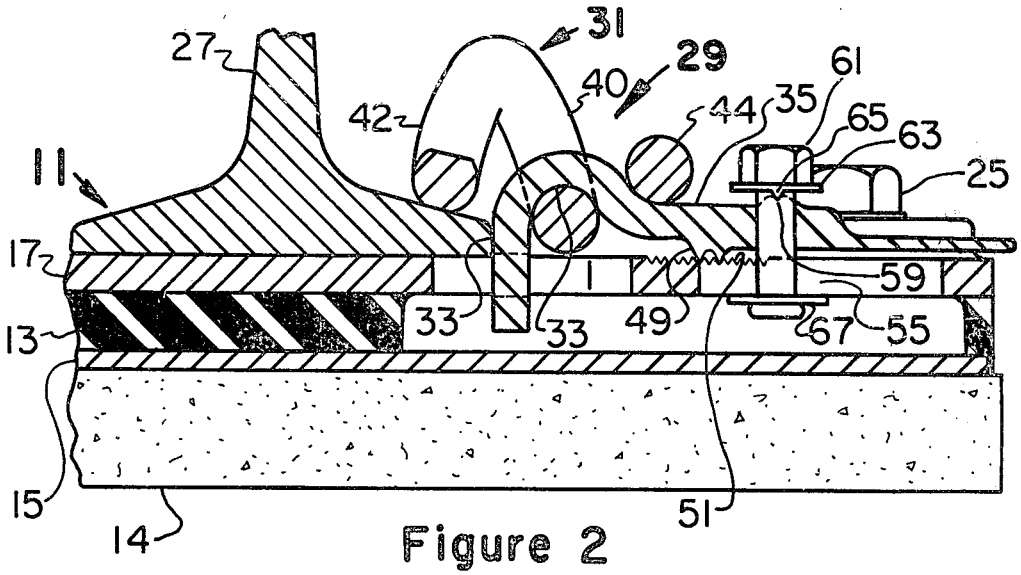
FIG. 2 is a partial cross-sectional view of the base assembly of FIG. 1 showing the attachment of the inventive bracket herein to a resilient rail clip.
Figure 3:
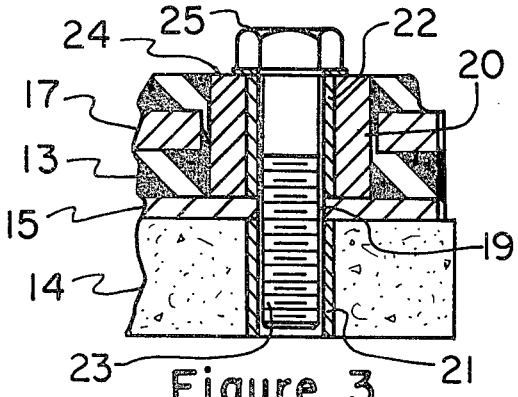
FIG. 3 is a partial cross-sectional view taken generally along line 3—3 of FIG. 1 showing the anchorage means of the base assembly to the concrete supporting structure.

Referring now to the drawings, and in particular to FIGS. 1 and 2, a direct fixation base assembly is shown and labelled generally with the reference 11. Only a portion of the base assembly 11 and the fastening means of the present invention located on one side of rail 27 are shown in the drawings for purposes of discussion and illustration, but it should be understood that the other side of rail 27 is essentially identical. A suitable support structure, preferably a section of precast or cast-in-place concrete 14, receives and supports base assembly 11 on the track bed. The base assembly 11 includes a layer of resilient elastomeric material 13 disposed between and attaching to a base plate 15 and a top plate 17. The elastomer layer 13 may be secured to plates 15 and 17 by vulcanization, adhesive coatings or any other suitable means. A bore 19 is machined adjacent the end of base assembly 11 through bottom plate 15. A larger bore 20 is formed in top plate 17 and elastomer layer 13, concentric with bore 19, and receives a metal sleeve 22 which is press fitted within a plastic jacket 24. Both the metal sleeve 22 and jacket 24 bear against base plate 15.

A threaded sleeve 21 is embedded in concrete support 14 in alignment with bore 19 to receive a threaded bolt or stud 23 inserted through metal sleeve 22 and bore 19, for securely holding base assembly 11 in a fixed position on support 14. No lateral adjustment of base assembly 11 relative to support 14 is permitted herein and only the head 25 of bolt 23 is exposed to the weather, unlike many of the prior art systems mentioned above. In addition, graphite or any other suitable coating may be applied to the threads of bolt 23 and sleeve 21 to resist oxidation and permit tightening and loosening of bolt 23 with sleeve 21 after extended periods of time, should the need arise.

Figure 4:
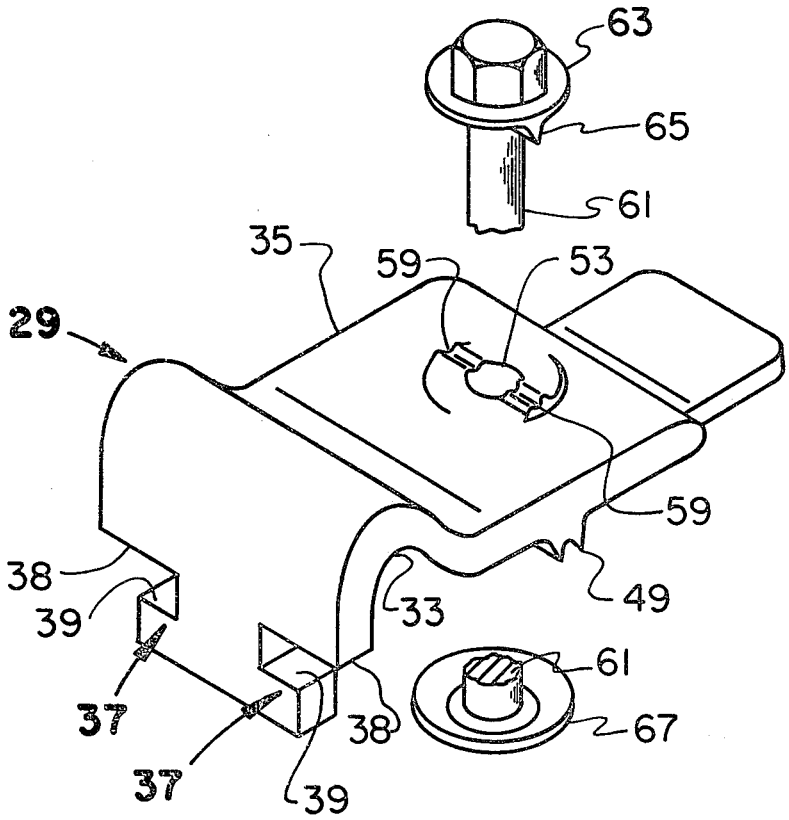
FIG. 4 is a perspective view of the bracket of the subject invention, including fastener locking means.

A standard rail 27 is disposed on top plate 17 directly above the elastomer layer 13. The elastomer layer 13 allows base assembly 11 to deflect in response to forces applied to rail 27 which reduces vibration and noise. Rail 27 is removably secured to base assembly 11 by a resilient rail clip such as a Pandrol clip 31, which, in turn, is held in place by the laterally adjustable fastener 29 of the present invention. As shown in FIGS 2 and 4, fastener 29 consists of a strip of steel or a suitable equivalent which is bent to form a bearing surface 34 at one end, an elongated straight section 35 at the other end and a curved section 33 therebetween, with the bearing surface 34 being perpendicular to straight section 35. A pair of slots 37 are punched or forged in the bearing surface 34 forming upper and lower shoulders 38 and 39, respectively. Top plate 17 of base assembly 11 is formed with a T-shaped keyhole 41, (See FIG. 1) including an elongated stem 43 and head section 45, to receive and support fastener 29. The fastener 29 is inserted into head section 45 such that the upper and lower shoulders 38 and 39 of slots 37 straddle top plate 17. Rail 27 is then placed in the desired position along the top plate 17 of base assembly 11, and fastener 29 is slid along stem 45 of keyhole 41 until bearing surface 34 abuts the rail 27.

Once fastener 29 is in position against rail 27, the Pandrol clip 31 may be driven into place. In this embodiment of the present invention, a straight or anchoring section 40 of Pandrol clip 31 is inserted within curved section 33 of fastener 29, and first and second bearing sections 42 and 44 of Pandrol clip 31 contact the rail 27 and straight section 35 of fastener 29, respectively. The curved section 33 of fastener 29 holds the Pandrol clip 31 laterally in place, and in cooperation with the lower shoulders 39 of slots 37 also resists upward movement of the Pandrol clip 31 which can occur as the rails in front of an approaching vehicle deflect upwardly in response to the leverage action from localized vertical forces applied directly to the rails by the vehicle wheels. The first bearing section 42 of Pandrol clip 31 securely holds the rail 27 in place on the top plate 17 of base assembly 11, and the second bearing section 44 of Pandrol clip 39 applies a downward force on the straight section 35 of fastener 29 providing additional resistance to lateral movement of the fastener 29, and in turn rail 27.

As a safety factor, the fastener 29 also includes independent means to resist lateral movement of rail 27 in the event Pandrol clip 31 should fail and become detached from rail 27. Referring now to FIGS. 4–7, the underside of straight section 35 of fastener 29 include a plurality of teeth 49 which are formed to engage serrations 51 provided in top plate 17. Serrations 51 may be located in top plate 17 at a point beyond keyhole 41 relative to rail 27 as shown in FIG 2, or along the stem 45 of keyhole 41 depending upon such considerations as the overall length of base assembly 11 and relative manufacturing costs.

In cooperation with the teeth 49 and serrations 51, cam locking means are provided by the present invention to positively lock fastener 29 in place and prevent lateral movement of rail 27 independently of Pandrol clip 31. As shown in FIG. 4, a bore 53 is drilled or punched into the straight section 35 of fastener 29 adjacent teeth 49 and a corresponding slot 55 is formed in top plate 17 in alignment with bore 53. In this embodiment of the cam locking means, at least one raised locking seat 59 is formed in straight section 35 of fastener 29 adjacent the periphery of bore 53. Fastener 29 is adjustably secured to top plate 17 by a pin 61, inserted through bore 53 and slot 55, having a flange 63 at its upper end which includes one or more tapered locking keys 65 formed to engage seat 59. The other end of pin 61, extending below top plate 17, receives a conical spring 67 which may be staked, welded or otherwise secured to pin 61.

In the unlocked position, the head of pin 61 is turned so that locking keys 65 rest on the straight surface 35 of fastener 29, placing conical spring 67 in its extended or released position. Teeth 49 may be disengaged from serrations 51 in the unlocked position, and fastener 29 is moveable along the stem 43 of keyhole 41 to permit lateral adjustment of rail 27. Of course, Pandrol clip 31 would also have to be disengaged from the curved surface 33 of fastener 29 to facilitate such lateral movement. Fastener 29 is placed in the locked position by turning pin 61 90° such that the keys 65 ride upwardly from the straight section 35 and engage seat 59, thus compressing conical spring 67, (See FIG. 2). In this mode, fastener 29 is held securely against rail 27 independently of Pandrol clip 31. Although vibration and some vertical movement of rail 27 would result if Pandrol clip 31 failed, fastener 29 resists the critical lateral movement of rail 27.

Figure 5:
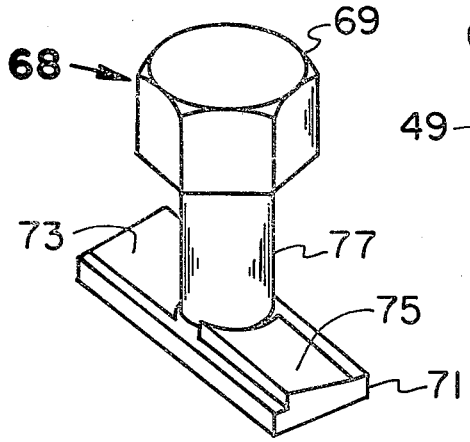
FIG. 5 is a perspective view of an alternate embodiment of the fastener locking means of the present invention.
Figure 6:
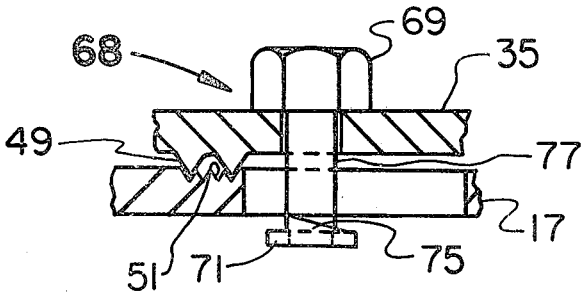
FIG. 6 is a partial side view of the fastener locking means of FIG. 5 in the locked position relative to the top plate and bracket.
Figure 7:
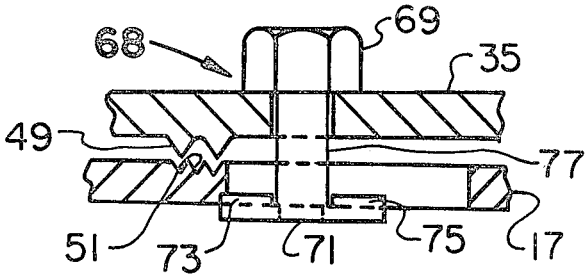
FIG. 7 is a partial side view of the fastener locking means of FIG. 5 in the unlocked position.

A second embodiment of the cam locking means of the present invention is shown in FIGS. 5–7. As in the previous embodiment, bore 53 and slot 55 are punched or machined into the straight section 35 of fastener 29 and top plate 17, respectively. A stud 68 having a standard hex head 69 at one end is inserted through bore 53 and slot 55, and a rectangular shaped base 71 is welded or otherwise attached to the stud shaft 77 at the other end. Base 71 is formed with first and second cam surfaces 73 and 75 on opposite sides of the stud shaft 77, which are beveled in opposite directions.

In the unlocked position, the beveled cam surfaces 73 and 75 are rotated into alignment with the slot 55 in top plate 17 allowing fastener 29 to be lifted upwardly to disengage teeth 49 from serrations 51. Fastener 29 is then free to move laterally along the stem 43 of keyhole 41 and along slot 55. The fastener 29 is placed in a locked position by rotating stud 68 90° such that the beveled cam surfaces 73 and 75 move out of slot 55 and bear against the underside of top plate 17. As in the locked condition of the previous embodiment, fastener 29 is securely held from lateral movement and effectively resists lateral displacement of rail 27 even if the Pandrol clip 31 should fail.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a base assembly for removeably mounting a rail on a support structure, said base assembly including a layer of resilient elastomeric material disposed between and attaching to a base plate and a top plate, said base assembly having anchoring means adjacent each end for attaching said base assembly in a fixed position to said support structure, said rail being positioned on said top plate and being secured thereto by a pair of resilient rail clips disposed on opposite sides of said rail, said rail clips having an anchoring section and first and second bearing sections, said top plate having an elongated cut-out on opposite sides of said rail, the improvement comprising laterally adjustable rail clip fastening means, said fastening means including a pair of sections of rigid material having a bearing surface at one end and a straight portion at the opposite end with a curved portion therebetween, said bearing surface and straight portion being generally perpendicular to one another, said bearing surface being formed with a pair of slots corresponding to the thickness of said top plate, one of said sections of rigid material being inserted within each of said elongated cut-outs in said top plate on opposite sides of said rail such that said slots in said bearing surface engage said top plate, said sections of rigid material being laterally moveable along said elongated cut-outs to position said bearing surface in abutment with said rail whereby said anchoring section of each of said rail clips is inserted within said curved portion of said sections of rigid material on each side of said rail to securely hold said rail clips in a position wherein said first bearing section contacts said rail and prevents movement of said rail relative to said base assembly.

2. The rail clip fastening means of claim 1 wherein the underside of said straight portion in each of said sections of rigid material includes a plurality of teeth, said top plate being formed with a plurality of correspondingly-shaped serrations on opposite sides of said rail to engage said teeth upon in-section of said sections of rigid material within said elongated cut-outs, said teeth and said cut-outs engaging to resist lateral movement of said sections of rigid material relative to said top plate.

3. The rail clip fastening means of claim 1 wherein said rigid material is spring steel.

4. The rail clip fastening means of claim 1 wherein each of said sections of rigid material include fastener securing means comprising a pin having a flange at one end and spring means at the other end, said pin being insertable through a bore formed in said straight portion of said sections of rigid material and through an elongated slot formed in said top plate in alignment with said bore such that said flange bears against the top of said straight portion and said spring means bears against the underside of said top plate, said flange having at least one tapered locking key formed in the underside thereof, said straight portion having a seat shaped to receive said locking key, said fastener securing means being operable to lock said sections of rigid material into position along said top plate independently of said rail clips by turning said shaft to move said locking key into engagement with said seat and thereby stressing said spring means against said top plate.

5. The rail clip fastening means of claim 4 wherein said fastener securing means is operable to unlock said sections of rigid material from said top plate to permit relative lateral movement therebetween by moving said locking key out of engagement with said seat thereby releasing said spring means from said top plate.

6. The rail clip fastening means of claim 1 wherein each of said sections of rigid material include fastener securing means comprising a stud having a head at one end and a pair of cam surfaces at the other end, said cam surfaces being beveled in opposite directions, said stud being insertable through a bore formed in said straight portion of said sections of rigid material and through an elongated slot formed in said top plate in alignment with said bore such that said head bears against the top of said straight portion, said fastener securing means being operable to lock said sections of rigid material into position along said top plate independently of said rail clips by turning said stud to move said beveled cam surfaces from said elongated slot and into engagement with the underside of said top plate.

7. In a base assembly for removeably mounting a rail on a support structure, said base assembly including a layer of resilient elastomeric material disposed between and attaching to a base plate and a top plate, said base assembly having anchoring means adjacent each end for attaching said base assembly in a fixed position to said support structure, said rail being positioned on said top plate and being secured thereto by a pair of resilient rail clips disposed on opposite sides of said rail, said rail clips having an anchoring section and first and second bearing sections, said top plate having an elongated cut-out on opposite sides of said rail, the improvement comprising laterally adjustable rail clip fastening means, said fastening means including a pair of sections of rigid material having a bearing surface at one end and a straight portion at the opposite end with a curved portion therebetween, said bearing surface and straight portion being generally perpendicular to one another, said bearing surface being formed with a pair of slots corresponding to the thickness of said top plate, one of said sections of rigid material being inserted within each of said elongated cut-outs in said top plate on opposite sides of said rail such that said slots in said bearing surface engage said top plate, said sections of rigid material being laterally moveable along said elongated cut-outs to position said bearing surface in abutment with said rail, said sections of rigid material having locking means engageable with said top plate for locking said sections in said position of abutment with said rail, whereby said anchoring section of each of said rail clips is inserted within said curved portion of said sections of rigid material on each side of said rail to securely hold said rail clips in a position wherein said first bearing section contacts said rail and prevents movement of said rail relative to said base assembly.

8. In a base assembly for removeably mounting a rail on a support structure, said base assembly including a layer of resilient elastomeric material disposed between and attaching to a base plate and a top plate, said base assembly having anchoring means adjacent each end for attaching said base assembly in a fixed position to said support structure, said rail being positioned on said top plate and being secured thereto by a pair of resilient rail clips disposed on opposite sides of said rail, said rail clips having an anchoring section and first and second bearing sections, said top plate having an elongated cut-out on opposite sides of said rail, the improvement comprising laterally adjustable rail clip fastening means, said rail clip fastening means including a pair of sections of rigid material having a bearing surface at one end and a straight portion at the opposite end with a curved portion therebetween, said bearing surface and straight portion being generally perpendicular to one another, said bearing surface being formed with a pair of slots corresponding to the thickness of said top plate, one of said sections of rigid material being inserted within each of said elongated cut-outs in said top plate on opposite sides of said rail such that said slots in said bearing surface engage said top plate, said sections of rigid material being laterally moveable along said elongated cut-outs to position said bearing surface in abutment with said rail, said sections of rigid material being held in abutment with said rail by fastener securing means including a pin having a flange at one end and spring means at the other end, said pin being insertable through a bore formed in said straight portion of said sections of rigid material and through an elongated slot formed in said top plate in alignment with said bore such that said flange bears against the top surface of said straight portion and said spring means bears against the underside of said top plate, said flange having at least one tapered locking key formed in the underside thereof, said straight portion having a seat shaped to receive said locking key, said fastener securing means being operable to lock said sections of rigid material into position along said top plate by turning said pin to move said locking key into engagement with said seat and thereby stressing said spring means against said top plate, whereby said anchoring section of each of said rail clips is inserted within said curved portion on each side of said rail to securely hold said rail clips in a position wherein said first bearing section contacts said rail and in cooperation with said fastener securing means prevents movement of said sections of rigid material and said rail relative to said base assembly.

9. In a base assembly for removeably mounting a rail on a support structure, said base assembly including a layer of resilient elastomeric material disposed between and attaching to a base plate and a top plate, said base assembly having anchoring means adjacent each end for attaching said base assembly in a fixed position to said support structure, said rail being positioned on said top plate and being secured thereto by a pair of resilient rail clips disposed on opposite sides of said rail, said rail clips having an anchoring section and first and second bearing sections, said top plate having an elongated cut-out on opposite sides of said rail, the improvement comprising laterally adjustable rail clip fastening means including a pair of sections of rigid material having a bearing surface at one end and a straight portion at the opposite end with a curved portion therebetween, said bearing surface and straight portion being generally perpendicular to one another, said bearing surface being formed with a pair of slots corresponding to the thickness of said top plate, one of said sections of rigid material being inserted within each of said elongated cut-outs in said top plate on opposite sides of said rail such that said slots in said bearing surface engage said top plate, said sections of rigid material being laterally moveable along said elongated cut-outs to position said bearing surface in abutment with said rail, said sections of rigid material being held in abutment with said rail by fastener securing means including a stud having a head at one end and a pair of cam surfaces at the other end, said cam surfaces being beveled in opposite directions, said stud being insertable through a bore formed in said straight portion of said sections of rigid material and through an elongated slot formed in said top plate in alignment with said bore such that said head bears against the top of said straight portion, said fastener securing means being operable to lock said sections of rigid material into position along said top plate by turning said stud to move said beveled cam surfaces from said elongated slot and into engagement with the underside of said top plate, whereby said anchoring section of each of said rail clips is inserted within said curved portion of said sections of rigid material on each side of said rail to securely hold said rail clips in a position wherein said first bearing section contacts said rail and in cooperation with said fastener securing means prevents movement of said sections of rigid material and said rail relative to said base assembly.

* * * * *